US005957741A

United States Patent [19]

Evans

[11] Patent Number: 5,957,741

[45] Date of Patent: Sep. 28, 1999

[54] QUICK RELEASE DEVICE FOR SURFBOARD SAFETY LEASHES

[76] Inventor: James H. Evans, 4482 Rancero Dr., Soquel, Calif. 95073

[21] Appl. No.: 08/959,249

[22] Filed: Oct. 28, 1997

[51] Int. Cl.[6] ..... B63B 1/00

[52] U.S. Cl. ..... 441/75

[58] Field of Search ..... 441/74, 75

[56] References Cited

U.S. PATENT DOCUMENTS

| | | | |
|---|---|---|---|
| 5,531,622 | 7/1996 | Nealy | 441/75 |
| 5,643,028 | 7/1997 | Craig | 441/75 |
| 5,685,751 | 11/1997 | Feyas | 441/75 |
| 5,775,965 | 7/1998 | Hango | 441/75 |

*Primary Examiner*—Stephen Avila
*Attorney, Agent, or Firm*—Jeffrey A. Hall

[57] ABSTRACT

A quick release device for a surfboard safety leash, for facilitating the rapid release of an ankle strap of the surfboard safety leash from the user's leg or ankle. The device comprises an indicator mass for determining the position and location of the fastening end of the ankle strap of the surfboard safety leash. The indicator mass is secured to the ankle strap of the surfboard safety leash allowing for quick and positive determination of the position and location of the end of the ankle strap of the surfboard safety leash. The indicator mass may be configured in any geometric configurations such as spherical, square, rectangular, triangular, or other shapes as desired. An attachment cord for attaching and positioning the indicator mass onto the surfboard safety leash is secured to the ankle strap or ankle cuff of the surfboard safety leash so that when a pulling force is applied to the indicator mass or attachment cord, the ankle strap of the surfboard safety leash releases from the user's ankle or leg. The attachment cord being removably secured to the surfboard safety leash which allows for attachment or removal of the indicator mass from the surfboard safety leash.

19 Claims, 2 Drawing Sheets

QUICK RELEASE DEVICE FOR SURFBOARD SAFETY LEASHES

BACKGROUND OF THE INVENTION

1. Field of Invention

This invention relates to leashes and security straps for surfboards, bodyboards, skimming devices, and the like, and more particularly to devices for the quick release and disengagement of leashes attached to a surfboard, body board, snowboard, skis, skimming board or related apparatus.

2. Description of the Related Art

Surfboard leashes are tether lines connected to a surfboard at one end, and to the surfer's ankle at the other end. The same design feature applies to snowboards, skis, skimming boards or related apparatus. In the case of the body board, the body end of the lease is usually attached to the user's wrist. The leash is designed to provide surfers both the convenience and security in the water by restricting the distance their boards may travel when the surfer is separated from the board either by falling or abandoning the board in large surf conditions. The leash, usually between 6 feet and 10 feet long depending on the length and weight of the board, allows the board to be retrieved quickly, permitting the surfer to regain fast access to the waves while limiting the danger of drowning from having to swim to retrieve the board or reach the safety of shore.

Various surfboard leashes have been proposed and implemented for different surfboard sizes and weights and are generally constructed of a durable resilient material such as nylon, inside a rubber sheath, which serves as the tether line. At either end of the tether is a connecting device, generally a small metal swivel, that attaches to a cloth strap on one end and an ankle cuff on the other, normally made from hook and loop fastening elements. On the surfboard end the cloth strap usually made of nylon and hook and loop fastening elements is designed to pass through a thin cord attached to the back of the surfboard and is secured using hook and loop fasteners or other fastening means. On the ankle end, the cuff or ankle strap is wider and is secured by encircling the ankle with overlapping hook and loop fasteners, such as Velcro. The hook and loop fasteners, as long as they remain clean and crisp, create a strong bond between the surfer and the surfboard.

The convenience and safety factors of that bond have made the leash an essential part of a surfer's equipment. However, there are times when the strength of the hook and loop fasteners is a liability, such as when a leash is caught on a rock or reef, or when the board is held by the powerful turbulence of a crashing wave, either of which can prevent the surfer from reaching the surface for air. There have been numerous instances of surfers around the world who have died or suffered serious injury because they could not disengage from their leashes in emergency situations. The primary problem is in locating the end of the hook and loop fastener ankle strap or cuff, which tends to move about the ankle and lie flat against the cuff, and can be very difficult to locate even when the surfer is relaxed. It is especially difficult to locate in turbulent, dark and often cold conditions. This problem is exacerbated when the surfer's fingers are numb from cold water or gloves are used, and is even more difficult when the surfer is desperate for air and panic sets in.

This dual-edged nature of the surfboard leash has been recognized ever since the leash was introduced in the early 1970s. Some leash manufactures began attaching a short loop, often of nylon, to the end of the hook and loop fastener ankle strap or cuff so a surfer's finger could be inserted and pull the hook and loop fasteners apart. However, this was not a satisfactory solution to the problem as the loop would also lie flat against the cuff or ankle strap and is nearly indistinguishable from any other part of the cuff or ankle strap.

Significant efforts have been focused on solving such problems. However, prior attempts to improve on the surfboard leash and the quick release problem have been severely limited. For example, U.S. Pat. No. 4,234,990 issued Nov. 25, 1980 to Colburn disclosed a pin for detaching the tether from the ankle strap or cuff. U.S. Pat. No. 5,205,021 issued Apr. 27, 1993 to Durand disclosed a quick release buckle assembly to release the ankle from the strap. U.S. Pat. No. 5,531,622 issued Jul. 2, 1996 to Nealy discloses a snap fastening device to detach the tether from the ankle strap or cuff, and U.S. Pat. No. 5,643,028 issued Jul. 1, 1997 to Craig discloses a foot-actuated switch to remove the tether from the ankle strap. None of these proposed devices offer a satisfactory solution to the problems associated with safety leashes and have not been embraced by the water or snow sports industries for a variety of reasons including the difficulty of locating and disengaging such devices in emergency situations. Such devices are known to detach unexpectedly, and they add unacceptable costs to leashes and are not practical because of the constant movement of the strap around the ankle. Such limitations undoubtedly have been a reason that such devices have not received widespread acceptance.

Accordingly, it is the primary object of this invention to provide a quick release device for surfboards, snowboards, bodyboards, and the like which allows for the efficient, effective, convenient, and safe, location, positioning, and release of a safety strap, even under dark, turbulent, cold, large wave, and other hazardous or adverse situations. The device of the present invention is inexpensive to manufacture, install, remove, and replace. The quick release device for safety leashes of the present invention is also easy to use, quickly deployable in a number of easily anchored positions, and quickly and easily stored when not in use. The quick release device of the present invention may be used many times before replacement, does not, in most instances require modification of existing leashes for its deployment, and provides multiple positioning possibilities so that it can be used regardless of the type or size of the leash.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a quick release device is provided for a surfboard safety leash, for facilitating the rapid location and release of an ankle strap of the surfboard safety leash from the user's leg or ankle. The device comprises an indicator mass for determining the position and location of the end of the ankle strap of the surfboard safety leash. The indicator mass is secured to the ankle strap of the surfboard safety leash allowing for quick and positive determination of the position and location of the end of the fastening portion of the ankle strap of the surfboard safety leash, even under dark, turbulent, cold, large wave, or other adverse conditions. The indicator mass may be configured in any geometric configurations such as spherical, square, rectangular, triangular, or other shapes as desired. An attachment cord for attaching and positioning the indicator mass onto the surfboard safety leash is secured to the ankle strap or ankle cuff of the surfboard safety leash so that when a pulling force is applied to the indicator mass or attachment cord, the ankle strap of the surfboard safety leash releases from the user's ankle or leg. The attachment cord is removably secured to the surfboard safety leash which allows for easy attachment or removal of the indicator mass from the surfboard safety leash.

The quick release device of the present invention may be provided in a variety of shapes and sizes to accommodate different leash types, and individual choices and styles. The indicator mass may be composed of rubber, plastic or other durable resilient material, and the attachment cord is preferably composed of a nylon or other durable resilient material, such as rubber, plastic, cloth or the like.

The present invention is configured to permit rapid location and release of a leash, such as a surfboard safety leash, even in emergency or adverse conditions. The device of the present invention may be easily secured to and used on existing surfboard leashes, or provided with as a feature of a new leash. By providing a clear and distinct landmark of the location and position of the end of the ankle strap or cuff of a surfboard leash, the quick release device of the present invention makes obvious the end of the ankle strap or cuff by providing the surfer an easily recognizable and graspable object on which to pull and dislodge the hook and loop fasteners.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention, a quick release device for a surfboard safety leash, for facilitating the rapid release of an ankle strap of the surfboard safety leash from the user's leg or ankle, comprising, indicator means for determining the position and location of an ankle strap, in particular, the end of the fastening portion of the ankle strap of the surfboard safety leash. The indicator means being secured to the ankle strap of the surfboard safety leash allowing for quick and positive determination of the position and location of the end portion of the ankle strap of the surfboard safety leash. Attachment means for attaching and positioning the indicator means onto the surfboard safety leash are secured to the surfboard safety leash so that when a pulling force is applied to the indicator means the ankle strap of the surfboard safety leash releases from the user's ankle or leg. The attachment means are removably secured to the surfboard safety leash allowing for attachment or removal of the indicator means from the surfboard safety leash.

In accordance with the present invention, there is also provided an improved surfboard safety leash of the type in which a tether line is secured to a surfboard at one end and to the surfer's ankle at the other end by an ankle cuff or strap, wherein the improvement comprises, indicator means for determining the position and location of the ankle strap, and in particular, the end portion of the surfboard safety leash; the indicator means being secured to the ankle strap of the surfboard safety leash allowing for quick and positive determination of the position and location of the end of the ankle strap of the surfboard safety leash. Attachment means for attaching and positioning the indicator means onto the surfboard safety leash are secured to the ankle strap of the surfboard safety leash so that when a pulling force is applied to the indicator means the ankle strap of the surfboard safety leash releases from the user's ankle or leg; the attachment means being removably secured to the ankle strap of the surfboard safety leash allowing for attachment or removal of the indicator means from the surfboard safety leash.

Figure 1:
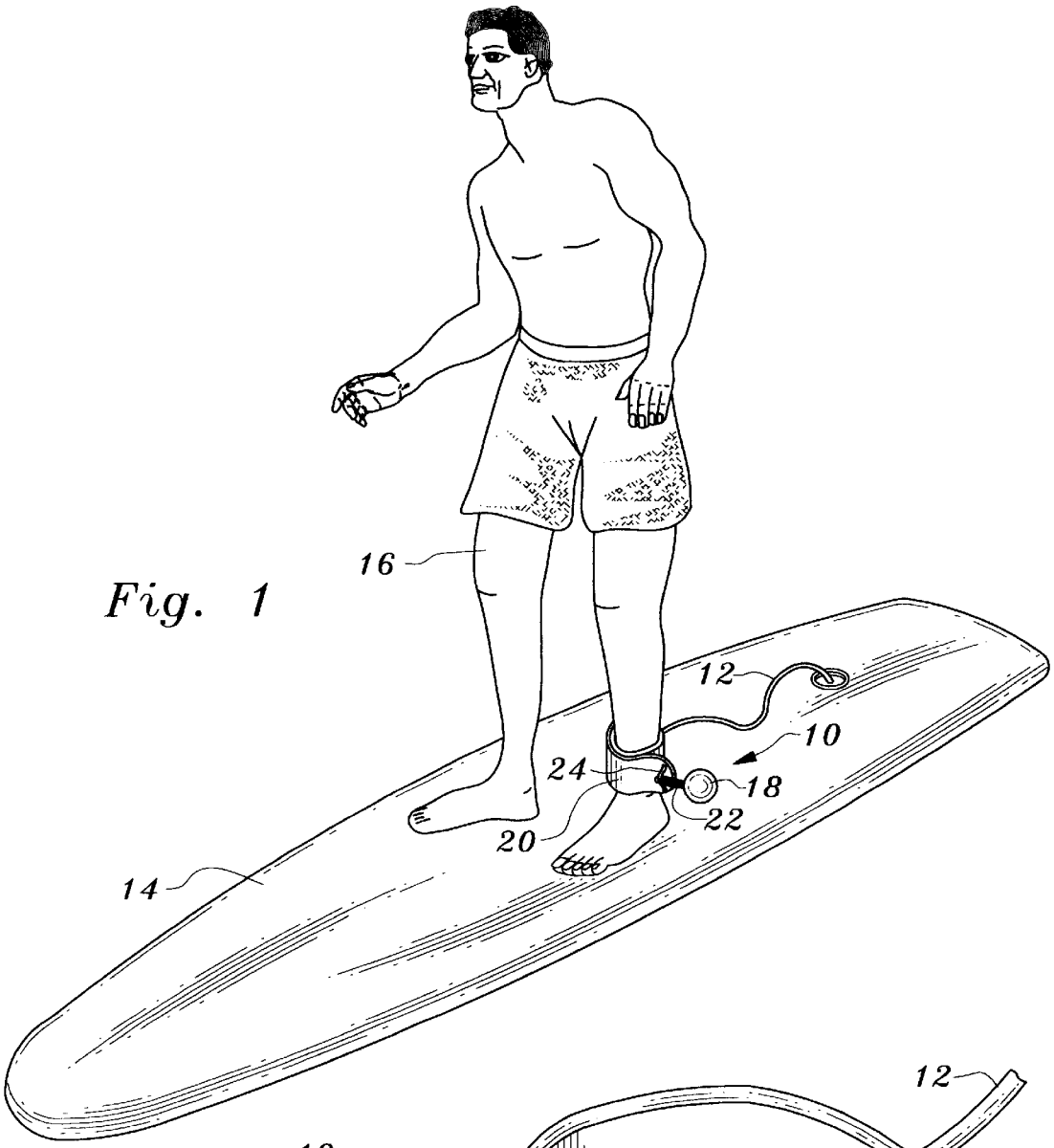
FIG. 1 is a front perspective view of a quick release device for surfboard safety leashes shown attached to a leash on a surfboard, according to the invention.
Figure 2:
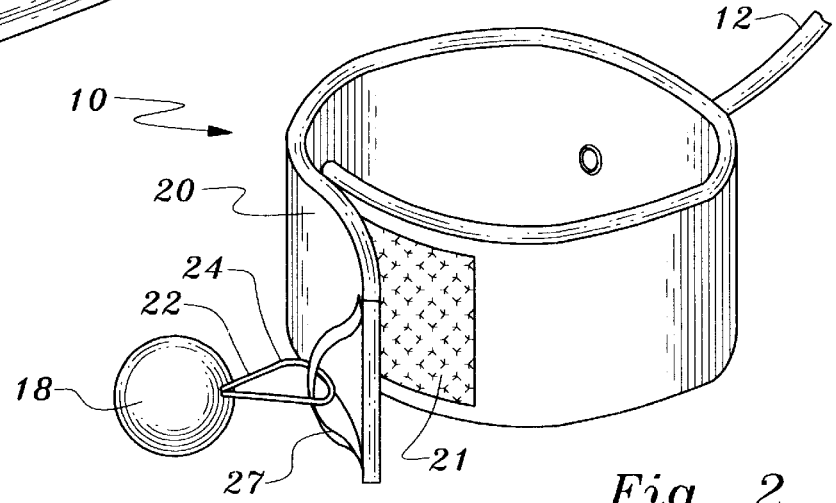
FIG. 2 is a perspective view of the quick release device for surfboard safety leashes shown attached to a finger loop on a surfboard ankle cuff, according to the invention.
Figure 2A:
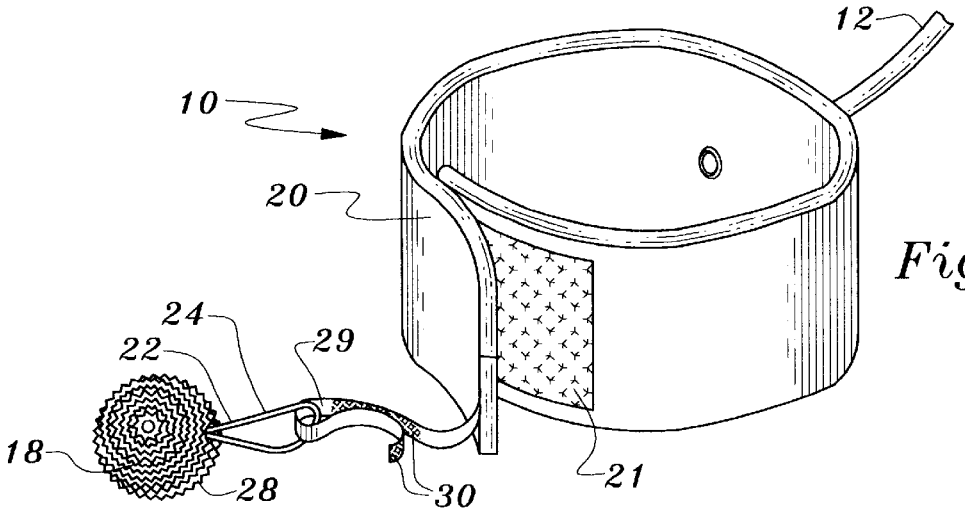
FIG. 2*a* is a perspective view of the quick release device for surfboard safety leashes shown attached to a hook and loop fastening element for attachment to a surfboard ankle cuff, according to the invention.

In FIG. 1, the quick release device 10 for a surfboard safety leash 12 or tether line, is shown according to a preferred embodiment of the invention on surfboard 14 with surfer 16. Indicator means, preferably comprising an indicator mass 18, is used for determining the position and location of the end of the ankle strap or cuff 20 of surfboard leash 12. Indicator mass 18 may be configured as a sphere, a square, a rectangle, a triangle, an oval, or any other configuration, as desired, and is sized to be grasped by a human hand. Indicator mass may have a smooth surface as seen in FIGS. 1 and 2, for example, or a textured surface, for example, as seen in FIG. 2*a* where a plurality of small projections comprise the indicator mass, or other surface configurations as desired. Typically, it will be about one half inch to one inch in diameter in the spherical configuration, or about one half inch square to one and one half inches square in the square configuration, for example. However, larger and smaller sizes may be used as desired.

Indicator mass 18 is preferably secured to ankle strap or cuff 20 of surfboard leash 12 to the end of hook and loop fastening segment 21 of ankle strap 20, allowing for the quick an positive determination of the position and location the end ankle strap 20, and when indicator mass 18 is pulled on hook and loop fastening segment 21, the user's ankle is released from surfboard leash 12. Indicator mass 18 is preferably composed of rubber, plastic, foam, cork or other durable resilient material.

Figure 3:
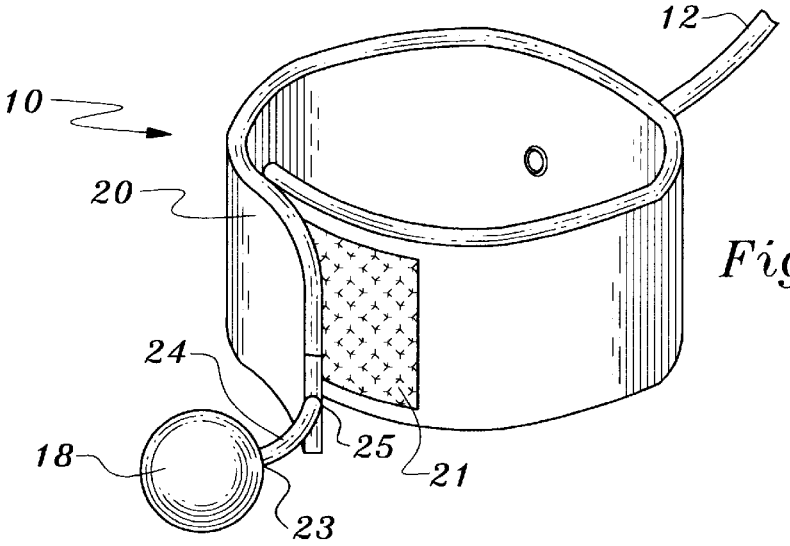
FIG. 3, is a perspective view of the quick release device for surfboard safety leashes shown attached directly to the end of the hook and loop fastener ankle strap, according to another embodiment of the invention.

Attachment means, preferably a cord 22 which may be provided in a looped configuration as in FIG. 1, or in a linear configuration as in FIG. 3, secures indicator mass 18 to ankle strap 20 of surfboard leash 12. If provided in the linear configuration as shown in FIG. 3, cord 22 is secured at a first end 23 to indicator mass 18 and at a second end 25 to ankle strap 20. The attachments means are preferably cord 22, however, various fastening means may be utilized, such as plastic or rubber tubing, covered wire, rings, clamps or other fastening means. Cord 22 is removably secured to ankle strap 20 by means such as looping loop 24 about finger loop 27 or strap or cuff 20, or tying cord 22 to strap or cuff 20, or otherwise securing thereto with rings, clamps, or the like. Cord 22 is preferably composed of nylon, however, plastic, rubber, string, or other durable, resilient material may be used.

Indicator mass 18 is preferably secured to attachment cord 22 by embedding cord 22 in mass 18. However, indicator mass may alternatively be secured with adhesives, small rings, clamps, or other fastening means well known in the art. Or, if a plastic or meltable cord is used, first end 23 may be melted or fused by heat to indicator mass 18.

In reference now to FIG. 2, quick release device 10 is shown attached to ankle strap or cuff 20 having finger loop 27, by looping indicator cord around finger loop 27. When indicator mass 18 is pulled by the user, this separates hook and loop fastening segment 21 of strap or cuff 20, thereby releasing surfboard leash 12 from the user's ankle. Indicator mass 18 may be used to release ankle strap or cuff 20 from a user's ankle under any conditions, however, it is particularly useful and advantageous under hazardous and difficult situations such as dark, turbulent, and large surf conditions.

In FIG. 2*a,* quick release device 10 is shown attached to a fastening element 29 with hook and loop fastening elements. Fastening element 29 may be sewn, secured by adhesives, clamped on, or otherwise secured to ankle strap or cuff 20. Attachment cord is secured in fastening element 29 by looping fastening element 29 about attachment cord 22 and securing the hook and loop fastening elements together. When indicator mass 18 is pulled by the user, this separates hook and loop fastening segment 21 of strap or cuff 20, thereby releasing surfboard leash 12 from the user's ankle. In FIG. 2*a,* indicator mass 18 is shown composed of a plurality of projections 28 making a rough or textured surface, however, smooth surfaces, or other textured surfaces may be used if desired.

In FIG. 3, quick release device 10 is shown attached to the end of hook and loop segment 21. In this configuration, attachment cord 22 is provided in an essentially linear configuration with first end 23 and second end 25. First end 23 is secured to indicator mass 18 and second end 25 is secured directly to ankle strap or cuff 20, preferably at hook and loop segment 21, by tying, sewing, adhesives, heat fusion, rings, clamps, or the like.

Figure 4:
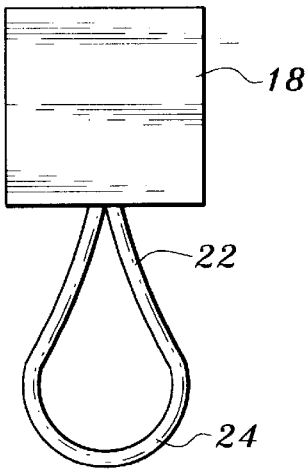
FIG. 4, is a front view of the quick release device for surfboard safety leashes shown with the indicator mass in a square configuration, according to the invention.

As is seen in FIG. 4, the quick release device 10 may be provided in a wide variety of shapes and sizes, here shown with indicator mass 18 in a square configuration. Attachment cord 22 is shown in a loop configuration with loop 24, however, it may alternatively be provided with a linear cord as in FIG. 3.

Figure 5:
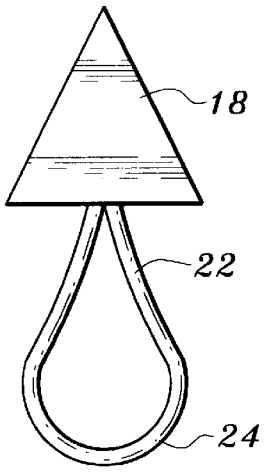
FIG. 5, is a front view of the quick release device for surfboard safety leashes shown with the indicator mass in a triangular configuration, according to the invention.

In FIG. 5, the quick release device 10 is shown with indicator mass 18 in a triangular or pyramidal configuration. Attachment cord 22 is shown in a loop configuration with loop 24, however, it may alternatively be provided with a linear cord as in FIG. 3. Of course, if desired, more than one indicator mass 18 may be used in the various configurations. If more than one indicator mass 18 is used on attachment cord 22, they may be provided in the same size, or in different sizes.

Figure 6:
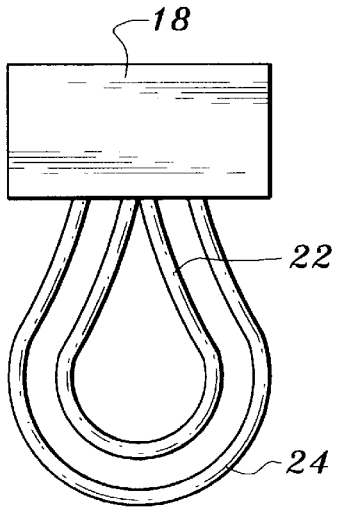
FIG. 6, is a front view of the quick release device for surfboard safety leashes shown with the indicator mass in a rectangular configuration with two attachment cords, according to the invention.

With reference now to FIG. 6, the quick release device 10 is shown with indicator mass 18 in a rectangular configuration with two attachment cords 22. Attachment cord 22 is shown in a loop configuration with loop 24, however, it may alternatively be provided with a linear cord as in FIG. 3. Of course, if desired, more than one indicator mass 18 may be used in the various configurations as described above, or with more than one attachment cord 24 may be used. However, as one attachment cord 22 is sufficient to secure quick release device 10 to ankle strap or cuff 20, the use of more than one attachment cord is a matter of providing different embodiments for consumer choice.

In operation and use quick release device 10 for surfboard safety leashes is very convenient, easy, reliable, and effective to use for the quick release of a surfboard ankle strap of cuff, even under the most extreme conditions of turbulence, darkness, cold, and large surf. Quick release device 10 may be used on all types of surfboard leashes and supplied as an item separate from the surfboard leash or with the leash. It is easily secured to or removed from a surfboard leash, does not interfere with the use of the leash, and is inexpensive to manufacture. Quick release device 10 has been described in detail in terms of its use as a quick release device for surfboard leashes, however, it may also be used on other sports and safety leashes in the same manner. For example, it may be used on bodyboard board wrist and arm leashes, on snowboard leashes, on skis safety leashes, or on skim board leashes.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A quick release device for a surfboard safety leash, for facilitating the rapid release of an ankle strap of the surfboard safety leash from the user's leg or ankle, comprising:

indicator means for determining the position and location of an ankle strap of the surfboard safety leash; the indicator means being secured to the ankle strap of the surfboard safety leash allowing for quick and positive determination of the position and location of the ankle strap of the surfboard safety leash; and an elongated fastening element for attaching and positioning the indicator means onto the surfboard safety leash, the elongated fastening element being secured to the surfboard safety leash so that when a pulling force is applied to the indicator means the ankle strap of the surfboard safety leash releases from the user's ankle or leg; the elongated fastening element being removably secured to the surfboard safety leash allowing for attachment or removal of the indicator means from the surfboard safety leash.

2. The quick release device of claim 1, wherein said indicator means for determining the position and location of said ankle strap of said surfboard safety leash comprises a mass sized to be grasped by a human hand.

3. The quick release device of claim 2, wherein said mass is spherically configured.

4. The quick release device of claim 2, wherein said mass is rectangularly configured.

5. The quick release device of claim 2, wherein said mass being in the configuration of a square.

6. The quick release device of claim 2, wherein said mass being in the configuration of a triangle.

7. The quick release device of claim 1, wherein said elongated fastening element for attaching and positioning said indicator means onto said surfboard safety leash comprises a cord being in the configuration of a loop and being secured at one end to the indicator means and being looped around said ankle strap of the surfboard leash.

8. The quick release device of claim 1, wherein said elongated fastening element for attaching and positioning said indicator means onto said ankle strap of the surfboard safety leash comprises a cord being attached at a first end to the indicator means and at a second end to said ankle strap of the surfboard safety leash.

9. The quick release device of claim 1, wherein said elongated fastening element for attaching and positioning said indicator means onto the ankle strap of the surfboard safety leash is embedded within the indicator means for determining the position and location of said ankle strap of the surfboard safety leash.

10. The quick release device of claim 2, wherein said mass is composed of rubber.

11. The quick release device of claim 2, wherein said mass is composed of plastic.

12. The quick release device of claim 2, wherein said cord is composed of nylon.

13. An improved surfboard safety leash of the type in which a tether line is secured to a surfboard at one end and to the surfer's ankle at the other end by an ankle cuff or strap, wherein the improvement comprises:

indicator means for determining the position and location of the ankle strap of the surfboard safety leash; the indicator means being secured to the ankle strap of the surfboard safety leash allowing for quick and positive determination of the position and location of the ankle strap of the surfboard safety leash; and a fastening element for attaching and positioning the indicator means onto the surfboard safety leash, the fastening element being secured to the ankle strap of the surfboard safety leash so that when a pulling force is applied to the indicator means the ankle strap of the surfboard safety leash releases from the user's ankle or leg; the fastening element being removably secured to the ankle strap of the surfboard safety leash allowing for attachment or removal of the indicator means from the surfboard safety leash.

14. The improved surfboard safety leash of claim 13, wherein said indicator means for determining the position and location of said ankle strap of said surfboard safety leash comprises a mass sized to be grasped by a human hand.

15. The improved surfboard safety leash of claim 14, wherein said mass is spherically configured.

16. The improved surfboard safety leash of claim 14, wherein said mass is rectangularly configured.

17. The improved surfboard safety leash of claim 13, wherein said fastening element for attaching and positioning said indicator means onto said ankle strap of said surfboard safety leash comprises a cord being in the configuration of a loop and being secured at one end to the indicator means and being looped around said ankle strap of the surfboard leash.

18. The improved surfboard safety leash of claim 13, wherein said fastening element for attaching and positioning said indicator means onto said surfboard safety leash comprises a cord being attached at a first end to the indicator means and at a second end to said ankle strap of the surfboard safety leash.

19. The improved surfboard safety leash of claim 13, wherein said fastening element for attaching and positioning said indicator means onto said ankle strap of said surfboard safety leash is embedded within the indicator means for determining the position and location of said ankle strap of the surfboard safety leash.

* * * * *